US006077138A

United States Patent [19]

Schulze

[11] Patent Number: 6,077,138

[45] Date of Patent: Jun. 20, 2000

[54] INFLATABLE LIFE RAFT WITH INFLATABLE SUPPORTS CONNECTED BY A THROTTLE VALVE

[75] Inventor: Bernd Schulze, Neugersdorf, Germany

[73] Assignee: Deutsche Schlauchbootfabrik Hans Scheibert GmbH & Co. KG, Germany

[21] Appl. No.: 09/191,908

[22] Filed: Nov. 13, 1998

[30] Foreign Application Priority Data

Nov. 15, 1997 [DE] Germany ..... 197 50 717

[51] Int. Cl.[7] ..... B63B 35/58

[52] U.S. Cl. ..... 441/40; 441/41

[58] Field of Search ..... 114/345; 441/35, 441/38, 40, 41

[56] References Cited

U.S. PATENT DOCUMENTS 2,854,014 9/1958 Hasselquist ..... 441/40

FOREIGN PATENT DOCUMENTS 812771 4/1959 United Kingdom ..... 441/38

*Primary Examiner*—Stephen Avila

*Attorney, Agent, or Firm*—Robert W. Becker & Associates

[57] ABSTRACT

A method for inflating a life raft, wherein the life raft has an inflatable base, at least two curved inflatable supports spanning the base, and extending parallel to one another, and a cover skin connected to the inflatable base and to the at least two inflatable supports, wherein in the inflated state of the life raft the base and the cover skin enclose the passenger compartment, includes a first step in which a first inflatable support is inflated until the first inflatable support is stable and provides a supporting action for the cover skin while subsequently in a second step the remaining inflatable support or supports are inflated.

3 Claims, 1 Drawing Sheet

INFLATABLE LIFE RAFT WITH INFLATABLE SUPPORTS CONNECTED BY A THROTTLE VALVE

BACKGROUND OF THE INVENTION

The present invention relates to a method for inflating life rafts whereby the life raft has an inflatable base and two or more inflatable curved supports extending substantially parallel to one another and spanning the base, whereby a cover skin is connected to the base and to the supports and whereby the cover skin and the base together enclose a passenger compartment.

It is known to connect the tubes of the base such with supports that during inflation of the base the pressure medium also flows into the supports. This type of inflation is favorable because the technical expenditure is minimal. However, it is a disadvantage of this type of inflation that waves crashing on the life raft prevent proper unfolding of the cover. One particular problem is that water can collect on the cover skin between two neighboring supports and the water collected there is difficult to remove.

It is therefore an object of the present invention to avoid the disadvantages mentioned above and to prevent that water crashing onto the life raft will collect on the cover skin between adjacent supports so that the cover skin can unfold properly.

SUMMARY OF THE INVENTION

As a solution to this object it is inventively suggested that a first one of the supports is inflated to such an extent that it is substantially stiff and provides a supporting action and to subsequently inflate the other supports which then also become stiff and provide a supporting action. It is understood that in the case of two parallel supports, which will be the most common life raft design, first one and then the other support will be inflated according to the invention. Expediently, the first support is unfolded simultaneously with the inflation of the tubes of the base and becomes stiff and stable. This can be achieved, for example, by flowing of pressure medium from the tubes of the base into the support. Once this step has been completed, the second support will be inflated in order to provide the required supporting action for the entire cover skin.

The invention is based on the recognition that based on the inventive principle the inflation of one support in connection with the cover skin provides a pitched roof which prevents collection of water on the cover skin. When under these conditions one of the supports is already stiff and provides a supporting action, the second and optionally further supports can then be inflated. It should be noted that the aforementioned advantages can be important for life rafts that are still submerged in water as well as in the aforementioned conditions on the water surface when the life raft is inflated while water or waves are splashing onto it. The present invention can also be useful in connection with self-righting life rafts whereby water collected on the cover skin can be drained off in these cases.

After inflation of the first support, the further support or supports can also be inflated, optionally by transfer lines, respectively, throttle elements. However, it is understood that individual pressure sources for the first as well as for the other supports may be provided.

The invention is not limited to a special design of the base and/or of the supports even though parallel supports or double supports are mostly used for oval or elongate bases.

Furthermore, the supports may be connected at the zenith by a transverse tube (stay) that provides a structure similar to a ridge beam of a roof.

BRIEF DESCRIPTION OF THE DRAWINGS

The object and advantages of the present invention will appear more clearly from the following specifications in conjunction with the accompanying drawing, in which.

DESCRIPTION OF PREFERRED EMBODIMENTS

Figure 1:
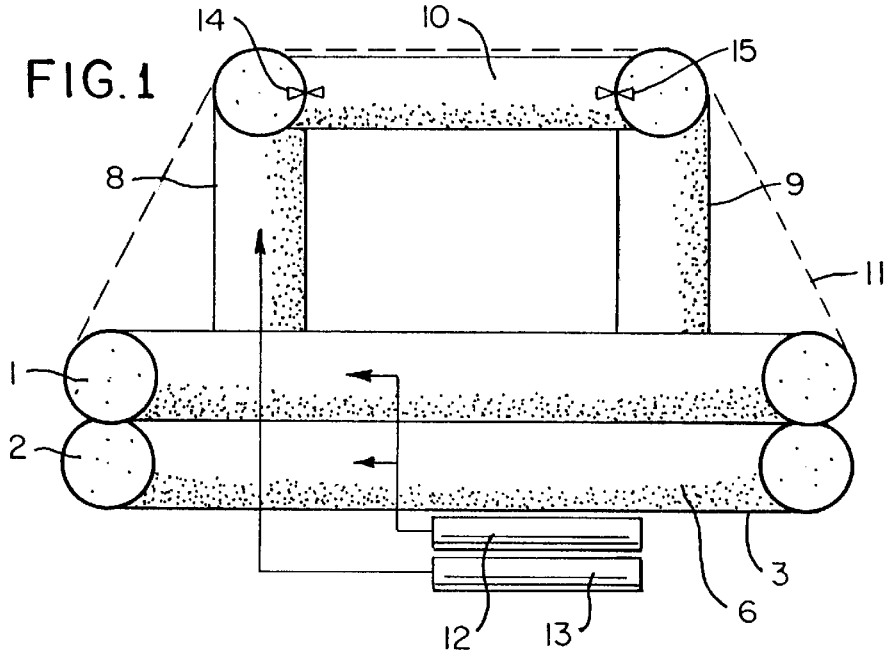
FIG. 1 shows an inflatable life raft in a side view in a section along the line l—l of FIG. 2.
Figure 2:
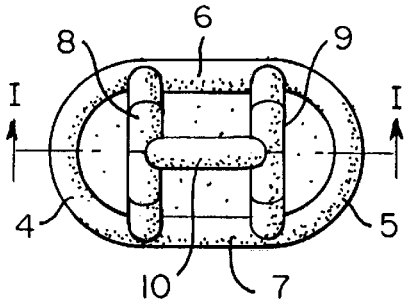
FIG. 2 shows the life raft in a plan view.
Figure 3:
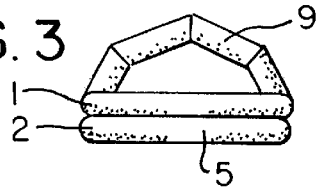
FIG. 3 shows a side view of FIG. 2.

The base of the life raft is comprised of substantially two stacked inflatable tubes 1 and 2 and a bottom 3. In plan view, the bases is substantially oval. Two curved sections 4, 5 and two straight parallel tube sections 6, 7 are provided. These tube sections 6,7 serve to connect thereto arc-shaped inflatable supports 8,9 which are connected at their zenith by a stay 10 which functions substantially as a ridge beam of the roof structure. These supports 8,9 extend parallel to one another while the stay 10 extends parallel to the tube sections 6, 7. The supports 8, 9 serve to support and secure a cover skin 11 having edges connected to the tube 1 thus forming a roof for the life raft. The shown representation does not include conventional, well known details of the life raft such as, for example, a doorway for entry into the passenger compartment.

In order to be able to use the compactly packaged life raft, it is necessary to inflate it. For this purpose two pressure sources in the form of pressure bottles 12, 13 are provided and contain a compressed gas such as air. The bottle 12 is connected to the two tubes 1, 2 and the bottle 13 is connected to the support 8 whose hollow interior is connected by a throttle valve 14 to the stay 10. Also, the stay 10 is connected to the hollow interior of the support 9 by a throttle valve 15, such that the stay 10 provides a passage for the compressed gas (pressure medium).

Figure 4:
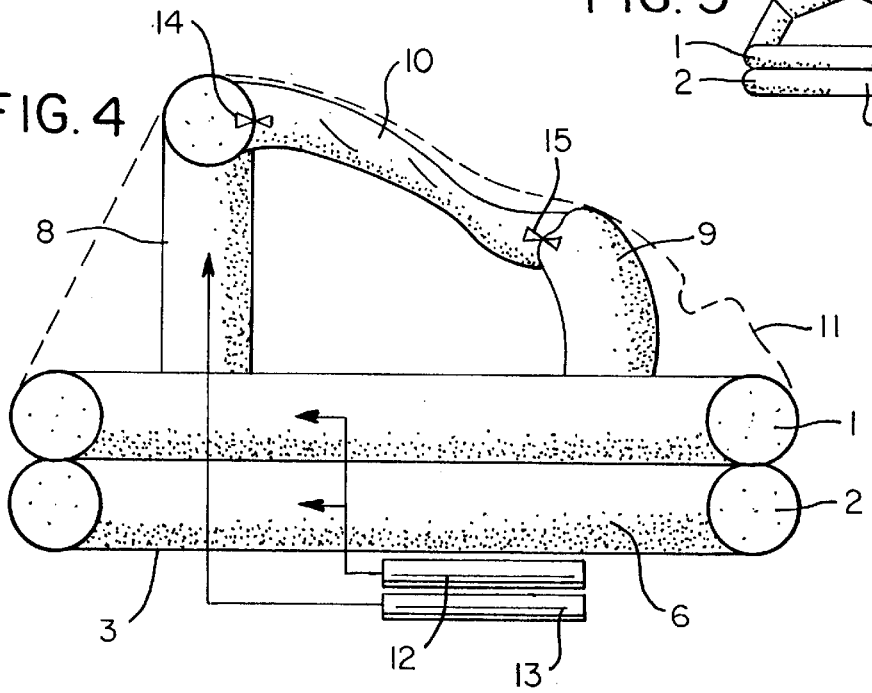
FIG. 4 shows the life raft in a representation according to FIG. 1 but not yet fully inflated.

For inflating the life raft, first the two tubes 1,2 are supplied with compressed gas by the bottle 12. At the same time, the support 8 is inflated to such an extent that it is stiff and stable and provides a supporting function for the cover skin 11. The support 9 and also the stay 10 are not yet form-stable, i.e., they are soft so that a state results as shown in FIG. 4. Accordingly, a pitched roof with a ridge beam provided by the tip of the support 8 results. This allows water splashing onto the life raft to run off the life raft toward the side.

Only after the state according to FIG. 4 has been reached, the inflation of the stay 10 through the throttle valve 14 and subsequently, with time delay, the inflation of the support 9 to the required stiffness and support action is carried out. In this context it is not detrimental that the compressed air or gas has already entered the stay 10 and the support 9 when the support 8 is not entirely form-stable. In any case, under the shown conditions of FIG. 4 the stay 10 and the support 9 are not yet stiff and cannot provide a support function for the cover skin 11. It is also important in this context that first one support, i.e., the support 8, receives the prescribed inner pressure and is thus able to provide the aforementioned pitched roof.

For a life raft that has three supports, the invention suggests that initially the centrally arranged support is inflated to a stable and stiff state, and only thereafter the two supports on either side are inflated to a stiff state. Furthermore, the invention does not necessarily require one or more stays at the ridge of the roof. However, in general, such stays are important because they provide in a simple manner the time delay for inflation i.e., they ensure the delayed inflation of the secondary support or supports.

It should be noted that the base in cross-section can be circular or oval or in any other suitable shape and, for example, can be of a polygonal design in certain sections. In all cases, the passenger compartment is surrounded by the base and covered by the cover skin.

The present invention is, of course, in no way restricted to the specific disclosure of the specification and drawings, but also encompasses any modifications within the scope of the appended claims.

What is claimed is:

1. A life raft comprising:

an inflatable base (1, 2, 3,);

at least two curved inflatable supports (8, 9) spanning said base (1, 2, 3) and extending parallel to one another;

a cover skin (11) connected to said inflatable base (1, 2, 3) and to said at least two inflatable supports (8, 9), wherein in the inflated state of said life raft said base (1, 2, 3) and said cover skin (11) enclose a passenger compartment;

a first means (13) for inflating a first one (8) of said at least two inflatable supports (8, 9);

at least one throttle valve (14, 15) connecting said first inflatable support (8) to remaining ones of said at least two inflatable supports (9) for inflating said remaining ones of said at least two inflatable supports (9) via said first inflatable support (8).

2. A life raft according to claim 1, comprising at least one inflatable stay (10) connecting neighboring ones of said at least two inflatable supports (8, 9), wherein said at least one inflatable stay (10) is connected with a first one of said at least one throttle valves (14) to said first inflatable support (8) and with a second one of said at least one throttle valves (15) to said neighboring ones of said at least two inflatable supports (8, 9).

3. A life raft according to claim 1, further comprising a second means (12) for inflating said base (1, 2, 3).

* * * * *